US006723282B1

(12) United States Patent
Chu et al.

(10) Patent No.: US 6,723,282 B1
(45) Date of Patent: Apr. 20, 2004

(54) METAL PRODUCT CONTAINING CERAMIC DISPERSOIDS FORM IN-SITU

(75) Inventors: Men Glenn Chu, Export, PA (US); Siba P. Ray, Murrysville, PA (US)

(73) Assignee: Alcoa Inc., Pittsburgh, PA (US)

( * ) Notice: Subject to any disclaimer, the term of this patent is extended or adjusted under 35 U.S.C. 154(b) by 252 days.

(21) Appl. No.: 09/350,858

(22) Filed: Jul. 9, 1999

Related U.S. Application Data

(62) Division of application No. 08/978,221, filed on Nov. 25, 1997, now Pat. No. 5,989,310.

(51) Int. Cl.[7] ..... C22C 21/00
(52) U.S. Cl. ..... 420/552; 420/590
(58) Field of Search ..... 420/552, 590

(56) References Cited

U.S. PATENT DOCUMENTS

| | | | | | |
|---|---|---|---|---|---|
| 3,144,323 | A | | 8/1964 | Watson et al. | 75/67 |
| 4,748,001 | A | | 5/1988 | Banerji et al. | 420/528 |
| 4,808,372 | A | | 2/1989 | Koczak et al. | 420/457 |
| 4,820,339 | A | | 4/1989 | Bienvenu et al. | 75/0.5 |
| 4,842,821 | A | | 6/1989 | Banerji et al. | 420/528 |
| 4,915,908 | A | * | 4/1990 | Nagle et al. | 420/590 |
| 5,041,263 | A | | 8/1991 | Sigworth | 420/552 |
| 5,401,338 | A | | 3/1995 | Lin | 148/538 |
| 5,405,427 | A | | 4/1995 | Eckert | 75/308 |

* cited by examiner

*Primary Examiner*—Scott Kastler
(74) *Attorney, Agent, or Firm*—David W. Pearce-Smith; Daniel P. Cillo

(57) ABSTRACT

A novel method for producing a ceramic phase particle dispersoid in metal and a novel product composed thereof. The method includes (a) providing a molten composition consisting essentially of molten aluminum alloy containing molten metal selected form the group consisting of Zr, V and combinations thereof; (b) providing a chloride salt containing fine carbon particles; and (c) reacting the chloride salt containing fine carbon particles in the molten aluminum metal liquid with the molten metal liquid to form a uniform distribution of finely sized carbide particles formed and dispersed in-situ in an aluminum alloy matrix.

4 Claims, 4 Drawing Sheets

METAL PRODUCT CONTAINING CERAMIC DISPERSOIDS FORM IN-SITU

CROSS REFERENCE TO THE RELATED APPLICATIONS

This application is a division of application Ser. No. 08/978,221, filed on Nov. 25, 1997 now U.S. Pat. No. 5,989,310.

TECHNICAL FIELD OF THE INVENTION

The present invention relates to fine ceramic particles formed in-situ in metal and in alloys by the liquid-state process, and to products containing the fine ceramic particles formed in-situ in metal and in alloys by the liquid-state process. In one aspect, the present invention relates to a process for producing a material containing uniformly dispersed, finely sized ceramic phase particles, e.g., such as titanium carbide particles, formed in-situ in metals and in alloys by the liquid-state process.

BACKGROUND OF THE INVENTION

The aluminum and aerospace industries have long sought a method to ran control recrystallization of aluminum alloys during deformation operations to permit the design of aluminum airframes with improved structural properties.

The metals industry today conventionally uses dispersoids, i.e., fine particles dispersed in the metal alloy, to control recrystallization and to increase dispersion strengthening at elevated temperatures. Such dispersoids of fine particles dispersed in the metal alloy usually are formed by solid state precipitation.

Recent developments in this area suggest that to improve formability and high temperature strength of aluminum alloys, it is necessary to increase the number densities and to reduce the size of the fine particle size dispersoids.

Certain emerging technologies are capable of producing fine particulates of different types with somewhat improved interfacial characteristics. Among the several ways of producing these materials, the technologies where the particles are introduced or formed in the molten aluminum prior to its solidification are attractive, primarily because of the potential for commercially economic processes on a large scale.

A variety of processing routes classified generally as in-situ ceramic phase formation processes in metal have been developed recently. According to the state of the reactants in the process, such a ceramic phase formation process in metal generally is classified into one of several categories:

(1) liquid metal—gas reaction, (2) liquid metal—liquid metal reaction, or (3) liquid—solid reaction.

In the case of carbon particles or carbon blocks in the context of liquid metal—liquid metal reactions or liquid—solid reactions, it is known that such carbon particles or carbon blocks are difficult to introduce directly into a melt in metal because of non-wetting of the carbon by the molten metal or alloy.

INTRODUCTION TO THE INVENTION

Recent developments in liquid metal—gas reaction processes have produced fine TiC particulates in a molten aluminum alloy. In this approach, a carbonaceous gas is introduced into an aluminum melt containing titanium to form TiC particulates, and the carbide volume fraction is determined by the initial titanium content. When the melt containing the carbides is cast and subsequently extruded for microstructure and property evaluation, the as-cast microstructure of the in-situ processed composites reveals a relatively uniform distribution of TiC particles with an average size of a few microns. No preferential particle segregation is observed in the dendritic cell boundaries generally.

U.S. Pat. No. 4,808,372, issued to Koczak et al., discloses an in-situ process for producing a composite containing refractory material. A molten composition, comprising a matrix liquid, and at least one refractory carbide-forming component are provided, and a gas is introduced into the molten composition. Methane is bubbled through a molten composition of powdered aluminum and powdered titanium to produce a carbide having an average particle size in the fine mode of about 3 to 7 microns and in the coarse mode of about 35 microns.

Although conventional ceramic phase formation processes in metal offer some possibilities for the production of a wide range of reinforcement particle types and improved compatibility between the reinforcement and the matrix, the in-situ formed ceramic particles in metal are too large, e.g., on the order of several microns, and tend to form clusters. In-situ formed ceramic particles having these sizes, i.e., of several microns, are candidates for use as reinforcement in a composite, but are not suitable for use as dispersoids for recrystallation control, for dispersion strengthening, or for use as a component for structure refinement.

Accordingly, a novel ceramic dispersoid in metal product and process for making such a novel ceramic dispersoid in metal product are needed for providing uniformly dispersed, finely sized ceramic phase particles dispersed in-situ in a metal matrix.

U.S. Pat. Nos. 4,842,821 and 4,748,001, issued to Banerji et al., disclose a method for producing a metal melt containing dispersed particles of titanium carbide. Carbon particles are reacted with titanium in the metal to obtain titanium carbide. The patent discloses that salts preferably are entirely absent from the melt (U.S. Pat. No. 4,842,821, col. 3, lines 26–28, and U.S. Pat. No. 4,748,001, col. 3, lines 40–42).

U.S. Pat. No. 5,405,427, issued to Eckert, discloses a flux composition for purifying molten aluminum to remove or capture inclusions in the melt and carry such inclusions to the surface (col. 4, line 13 et seq.). The flux composition contains sodium chloride, potassium chloride, and a minor amount of magnesium chloride and carbon particles.

U.S. Pat. No. 5,401,338, issued to Lin, discloses a process for making metal matrix composites wherein fine particles (0.05 microns) of alumina, silicon nitride, silicon carbide, titanium carbide, zirconium oxide, boron carbide, or tantalum carbide are added into a metal alloy matrix (col. 2, lines 64–68).

U.S. Pat. No. 5,041,263, issued to Sigworth, discloses a process for providing a grain refiner for an aluminum master alloy that contains carbon or other third, elements and acts as an effective refiner in solution in the matrix, rather than being present as massive hard particles.

Uniformly high number densities of finely sized dispersoids increase the recrystallization temperature, inhibit grain growth in hot working, and improve elevated temperature strength. Further, fine particles of dispersoids are effective nuclei for grain refining.

It is against this need in the background technology that the present invention was made.

Accordingly, it is an object of this invention to provide aluminum alloys having high number densities of fine ceramic particles to act as dispersoids.

Accordingly, it is an object of the present invention to provide a method for increasing the number densities of dispersoids in the liquid state and which then remain stable and dispersed in the solid state in metal alloys.

It is an object of the present invention to produce finely sized ceramic phase particles.

It is a further object of the present invention to produce uniformity in the dispersion of finely sized ceramic phase particles in metal and in alloys.

It is yet another object of the present invention to produce uniformly distributed, finely sized ceramic phase particles dispersed in-situ in a metal matrix.

It is another object of the present invention to produce uniformly distributed, finely sized ceramic phase particles dispersed in-situ in a metal alloy in a process providing reaction times shorter than conventional approaches.

It is another object of the present invention to produce uniformly distributed, finely sized ceramic phase particles dispersed in-situ in a metal alloy for rectystallization control, dispersion strengthening, or grain refining.

These and other objects of the present invention will become apparent from the detailed description which follows.

SUMMARY OF THE INVENTION

The present invention provides a novel method for producing a ceramic phase particle dispersoid in metal and a novel product composed thereof. The method includes (a) providing a molten composition consisting essentially of molten aluminum alloy and molten metal selected form the group consisting of Zr, V and combinations thereof; (b) providing a chloride salt containing fine carbon particles; and (c) reacting the chloride salt containing fine carbon particles in the molten aluminum metal liquid with the molten metal liquid to form a uniform distribution of finely sized carbide particles formed and dispersed in-situ in an aluminum alloy matrix.

The step of reacting includes vigorously stirring the mixture containing salt, metal alloy, and carbon to form a reaction mixture at a temperature above the liquidus of alloy to form a uniform distribution of particles sized less than about 2.5 microns uniformly dispersed in-situ in the metal matrix.

Another embodiment of the invention is a ceramic dispersoid in metal product comprising: (a) a matrix metal; and (b) a uniform distribution of formed and dispersed in-situ in the metal matrix. The finely sized ceramic particles are formed by the process of: (i) providing a molten composition comprising a matrix liquid of aluminum or aluminum alloy metal and at least one carbide-forming element selected from the group consisting of Ti, Sc, Hf, Nb, Zr, Mo, and V; (ii) providing a chloride salt containing carbon particles, wherein the salt comprises NaCl and KCl in a weight/weight ratio within the range of about 0.8—1.2 and of $MgCl_2$ and $CaCl_2$ in amounts comprising up to about 5–10% by weight of the salt mixture; and (iii) reacting the chloride salt containing carbon particles in the molten aluminum alloy by vigorously stirring the aluminum alloy and the chloride salt containing carbon particles to form a mixture of the molten metal liquid in contact with a portion of the carbon particles at an elevated temperature above the liquidus of the aluminum alloy to form a unagglomerated distribution of finely sized ceramic phase particles having an average particle diameter of less than about 0.3 microns formed and dispersed in-situ in an aluminum metal matrix;

DETAILED DESCRIPTION

Figure 1:
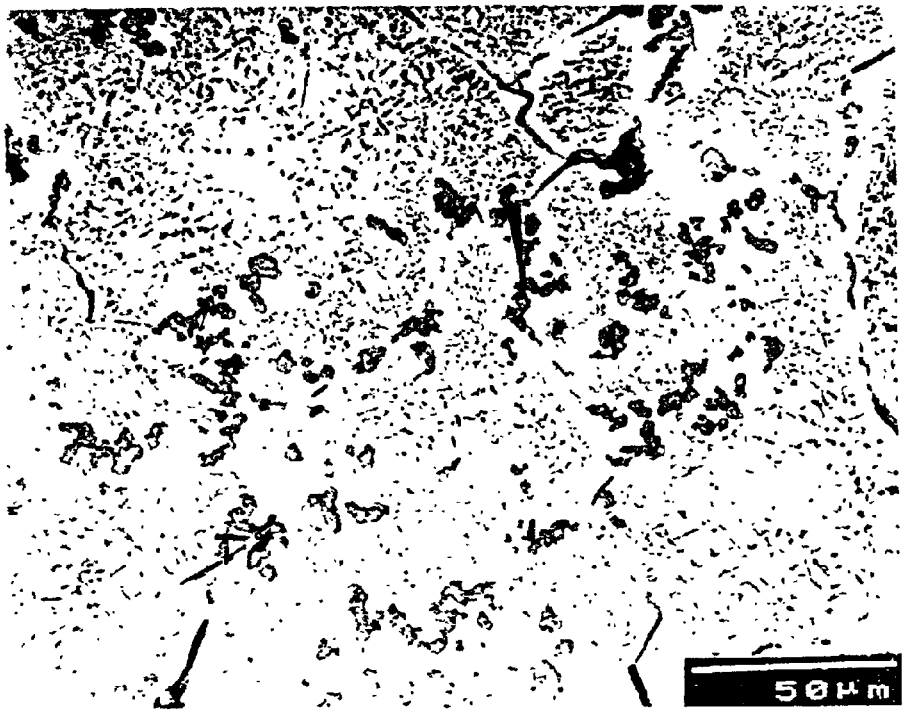
FIG. 1 shows a photomicrograph of a ceramic dispersoid in metal as produced by conventional processes available in the prior art.

The terms "fine" and "finely sized" as it refers to intermetallic particles is a particle being less than about 2.5 microns.

The present invention provides a novel liquid-state dispersoid-forming process, novel ceramic particle dispersoids formed in-situ in metal by the liquid-state process, and novel products containing the ceramic particle dispersoids formed in-situ in metal by the liquid-state process. In one aspect, the present invention provides a novel product and process for producing a material containing uniformly dispersed, finely sized ceramic phase particles. e.g., such as titanium carbide particles, formed in-situ in metal by the liquid-state dispersoid-forming process.

In one aspect, the novel ceramic dispersoid in metal product and process for producing such a ceramic dispersoid in metal include uniformly dispersed and finely sized carbide particles of the present invention formed in-situ in metal. In this one aspect, the present invention incorporates a novel mixing process involving the following two components:

(1) molten metal in combination with at least one of the carbide-forming elements including Ti, Sc, V, Hf, No, Zr, Mo, and Al (when the molten metal matrix is not aluminum); and (2) salt containing fine carbon particles or dissolved carbon or a combination of fine carbon particles and dissolved carbon.

The present invention includes controlling and selecting the liquidus temperature of the salt to a value lower than that of the molten metal. The present invention further includes controlling and selecting the salt for the purpose of wetting the carbon particles.

The present invention includes a specific mixing process, wherein a first component of molten metal containing carbide-forming elements is provided. A second component, either in the solid or molten state, initially is added to the first component of molten metal containing carbide-forming elements. When both first and second components are in the liquid state, the melt is vigorously stirred mechanically or electromagnetically over a period of time. During the stirring, the salt is finely dispersed, and the process of the present invention provides for the carbon to react with the carbide-forming element substantially instantaneously to form fine carbide particles. After reaction, the salt is decanted or removed.

The melt is then alloyed with any desirable alloying elements.

The alloy melt containing fine carbide particles is then cast into a mold, or cast to form ingot (rectangular or round), slab, sheet, or strip. The alloy melt can be spray formed to form bulk product.

The molten salt used for the process of the present invention enhances the reaction of carbon and the carbide-forming component in the alloy. The molten salt provides that the alloy is cleaned of any oxide or dross and, hence, a fresh surface is available for reaction. Carbon has some small but finite solubility in the molten salt. As reaction proceeds, the salt is depleted with respect to carbon. Hence, more carbon is dissolved, and the dissolved carbon reacts with the carbide forming element in the alloy to produce the fine particulates of carbides of the present invention. In accordance with the present invention, the carbon does not necessarily have to be dissolved in the molten salt for reaction to occur. Fine particulates of carbon also can take part in the reaction. Moreover, all of the carbon to be reacted need not be suspended in the salt at one time. Only a portion of the carbon need be in reactive contact, and when that carbon reacts, more carbon is brought into reaction contact by the vigorous stirring of the present invention.

The specific choice of salt composition in accordance with the present invention involves a molten salt containing elements which will not contaminate the metal by way of reacting with aluminum metal or aluminum alloying elements. The specific choice of salt composition in accordance with the present invention involves a salt which is thermodynamically stable and compatible with the metal. The present invention selects from the halide salts of alkali and alkaline earth metals. The halides of Na, K, Ca, Mg, and Li are preferred. Eutectic melts of binary, ternary, or quaternary salts with or without other additives may be used. The salt also preferably has a melting point below about 900° C. and, more preferably, below about 600° C. The eutectic melts of NaCl—KCl with small additions of $MgCl_2$ and $CaCl_2$ are particularly preferred. The NaCl and KCl weight/weight ratio should be about 1.0, preferably within 0.8–1.2. The additives of $MgCl_2$ and $CaCl_2$ preferably make up about 5–10% by weight of the salt mixture in accordance with the present invention.

In one aspect, the present invention employs a salt containing the following constituents and approximate percentages by weight, most preferably, NaCl: 48%, KCl: 48%, $MgCl_2$: 2.2%, and $CaCl_2$: 1.8%. This salt has a eutectic of about 600°–645° C., most preferably, of about 645° C.

The salt system of the present invention preferably has a eutectic capable of dissolving at a temperature below the liquidus of the metal matrix. e.g., in one aspect below the liquidus of aluminum is workable.

In addition, salts of $MgCl_2$—KCl, $MgCl_2$—NaCl, KCl—$CaCl_2$—NaCl also can be used in the system in accordance with the present invention. Salts having the eutectic composition and with the specified melting points will be preferred.

In addition, molten salts containing fluorides of Na, Ca, K, Mg, and Li can be used in the system in accordance with the present invention. When these fluoride salts are used, special care should be taken to provide that no excessive fluorides are evolved during the processing.

Although the process is described for carbides only, it can be extended to:

1. borides by incorporating boron in place of carbon,
2. nitrides, by incorporating nitrogen compounds such as AlN in place of carbon and
3. similar such refractory material compounds having relatively high melting temperatures and hardness, and relatively low chemical reactivity in comparison to non-refractory materials.

The present invention provides for the formation of fine carbide particles in metal. The particles produced in situ in metal in accordance with the present invention are well-dispersed in the metal. The process in accordance with the present invention includes mixing a molten metal of a carbide-forming element with a low liquidus temperature salt containing fine carbon particles or dissolved carbon. Both components are brought to reactive contact in the liquid state and thoroughly mixed. After reaction of carbon with carbide-forming element, the salt is decanted or removed. The melt which contains uniformly distributed, finely sized, unagglomerated carbide particles is cast into a mold or cast to form ingot and the like.

Referring now to FIG. 1, a section of casting is shown in microstructure by actual photomicrograph. A ceramic dispersoid in metal as produced by conventional processes available in the prior art is shown. Large size particles in uneven dispersion are apparent.

Figure 2:
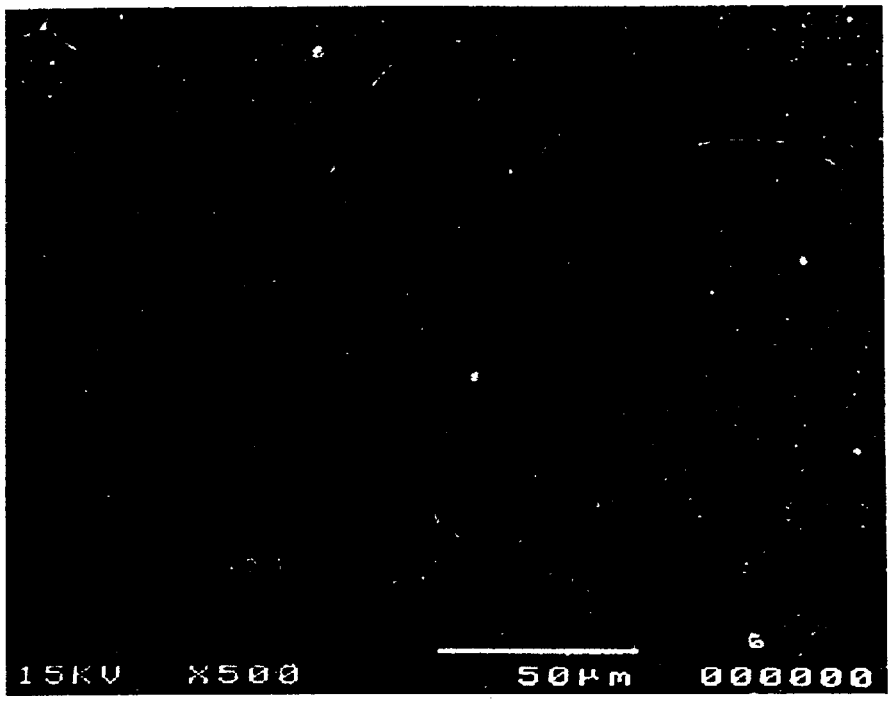
FIG. 2 shows a photomicrograph of a ceramic dispersoid in metal as produced and provided by the present invention.

Referring now to FIG. 2, a section is shown of the uniformly dispersed finely sized titanium carbide particles formed in situ in aluminum in accordance with the present invention. The particles are observed in microstructure to be finely sized with an average particle diameter less than about 0.3 microns and can be seen to be uniformly dispersed throughout the metal.

It has been found empirically that the present invention produces uniformly dispersed, finely sized ceramic phase particles formed and dispersed in-situ in a metal matrix. It has been found further that the present invention produces uniformly dispersed, finely sized ceramic phase particles formed and dispersed in-situ in a metal matrix in a process requiring reaction times shorter than existing conventional approaches, e.g., on the order of less than about one hour. The uniformly dispersed, finely sized ceramic phase particles dispersed in-situ in a metal matrix are suitable not only for application of reinforcement in a composite, but also for recrystallization control, dispersion strengthening, or grain refining.

EXAMPLE 1

A first component melt of 1.5 Kg of aluminum-2% titanium ( 1016 grams Al, 484 grams Ti) provided by Aluminum Company of America, Alcoa Technical Center, Alcoa Center, Pennsylvania, was prepared and heated to about 983° C. A second component mixture (922 grams total) of carbon particles and a salt (700 grams) containing about 48% NaCl, 48% KCl, 2.2% $MgCl_2$, and 1.8% $CaCl_2$ by weight was prepared and heated to about 200 F overnight. The preheated first and second components were added together in a crucible and heated to a temperature of about 983° C.

A mechanical stirring was applied by graphite propeller inserted into the crucible. A lid was placed to cover the crucible during reaction and to permit insertion of the graphite propeller and a thermocouple. After vigorous stirring and reaction for 15 minutes, the salt was skimmed, and the melt was cast into 1.5 inch diameter graphite molds. After cooling, the casting was cut for characterization.

The structure of the casting is shown in FIG. 2. As shown, the fine TiC particles are as small as submicrons in size and uniformly dispersed in the matrix.

The micro-composite particles of TiC in accordance with the present invention increase the ambient temperature strength and the elastic modulus of the aluminum base alloy.

EXAMPLE 2

A mixture of 2.6 grams of Al-6% Ti powder and 0.32 grams graphite powder. 0.72 grams was formed and then placed in an $Al_2O_3$ crucible of a DTA unit (Differential Thermal Analyzer). The crucible and sample was then heated to a temperature from room temperature 1300° C. at a rate of 50° C./min under an argon atmosphere.

Figure 3:
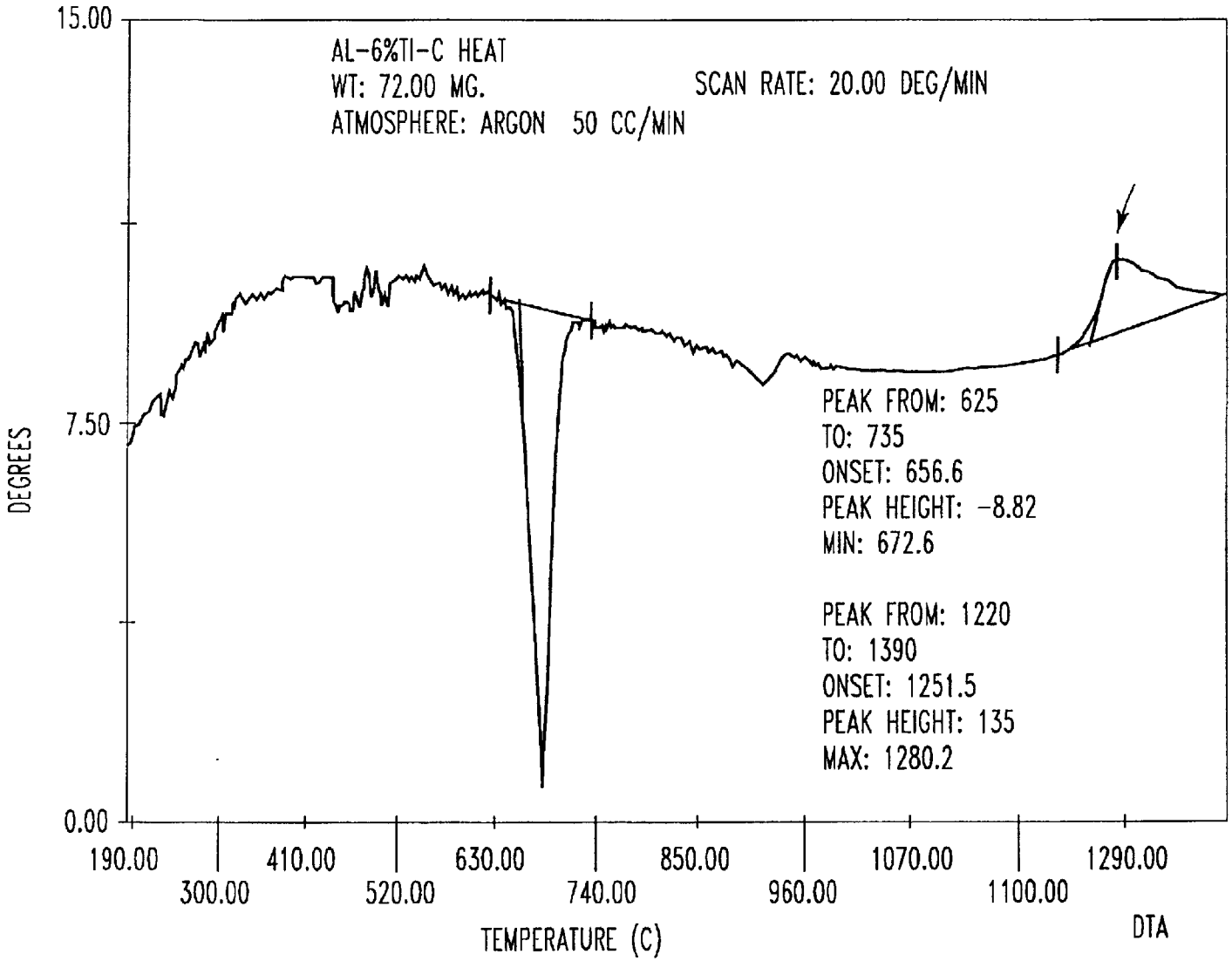
FIG. 3 is a DTA showing the temperature of formation of TiC.

The results of the DTA is shown in FIG. 3. A peak shown at approximately 1275° C. (as indicated by an arrow in FIG. 3) is an exothermic reaction, indicating the formation of TiC particles.

EXAMPLE 3

The procedure of Example 2 was repeated except that 2.6 grams of Al-5.7% Zr powder was mixed with 0.32 grams graphite powder. 0.71 grams. As before the mixture placed into an $Al_2O_3$ crucible of a DTA unit and heated to a temperature. 1300° C. at a rate of 50° C./min under an argon atmosphere.

Figure 4:
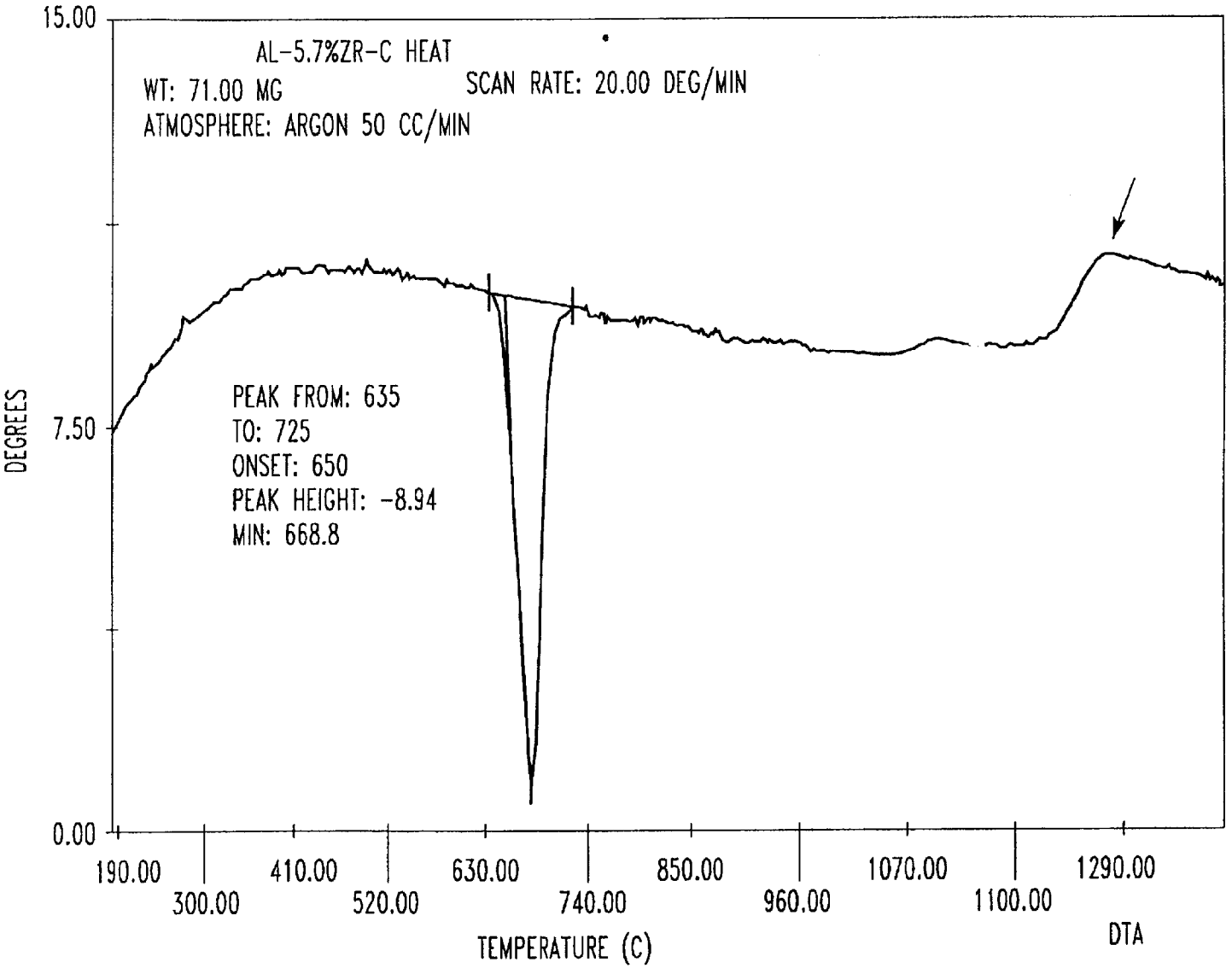
FIG. 4 is a DTA showing the temperature of formation of ZrC.

The results of the DTA is shown in FIG. 4. A peak shown at approximately 1275° C. (as indicated by an arrow in FIG. 4) is an exothermic reaction, indicating the formation of ZrC particles. These ZrC particles act as a dispersoid in aluminum alloys.

EXAMPLE 4

The procedure of Example 2 was repeated except that 2.6 grams of Al-5.1% V powder was mixed with 0.32 grams graphite powder. 0.71 grams of this mixture was then placed in an $Al_2O_3$ crucible of a DTA unit. The sample was heated to a temperature 1300° C. at a rate of 50° C./min under an argon atmosphere.

Figure 5:
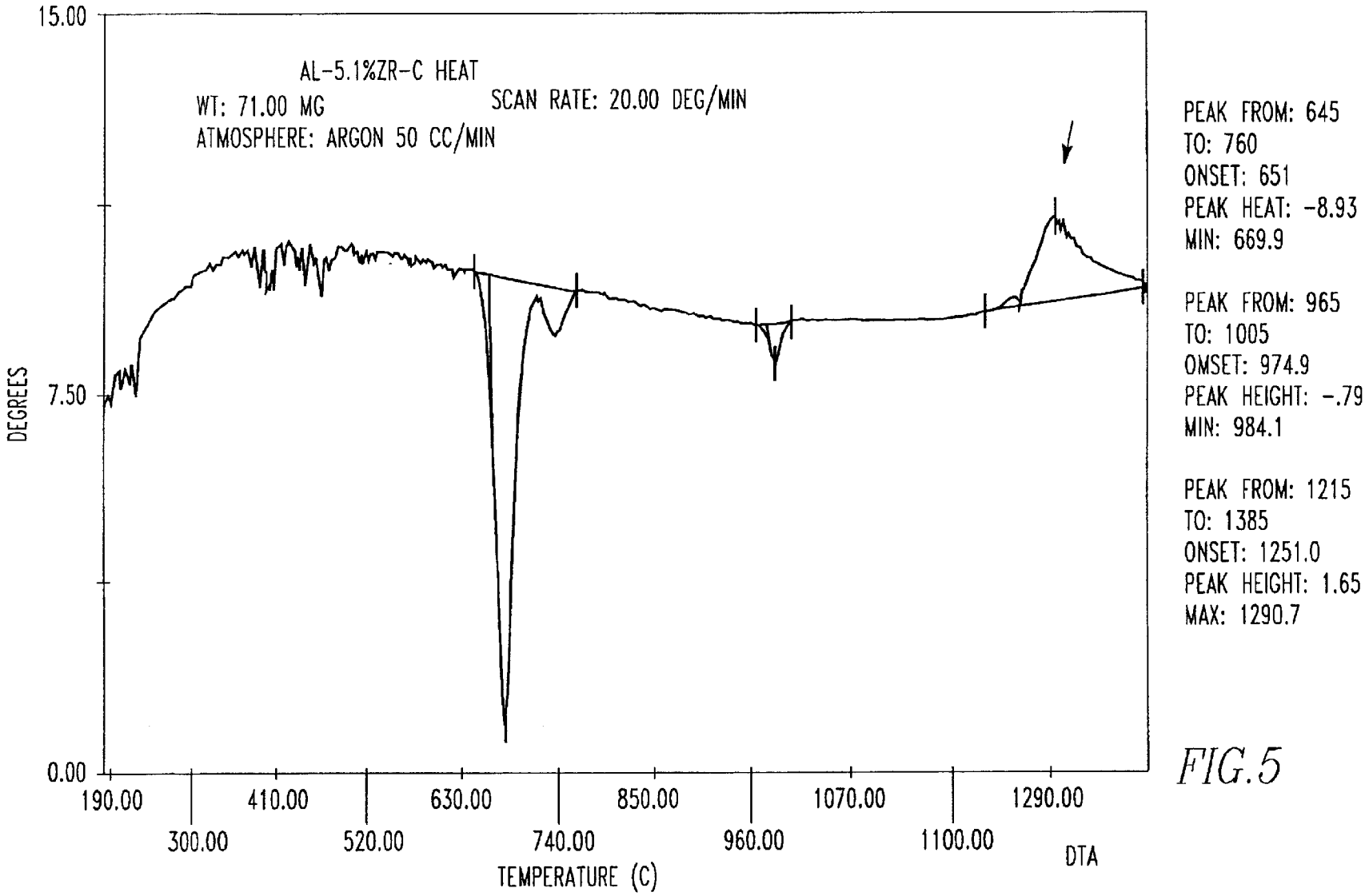
FIG. 5 is a DTA showing the temperature of formation of VC.

The results of the DTA is shown in FIG. 5. A peak shown at approximately 1270° C. (as indicated by an arrow in FIG. 5) is an exothermic reaction, indicating the formation of VC particles. These VC particles act as a dispersoid in aluminum alloys.

While the invention has been described in conjunction with several embodiments, it is to be understood that many alternatives, modifications, and variations will be apparent to those skilled in the art in light of the foregoing description. Accordingly, this invention is intended to embrace all such alternatives, modifications, and variations which fall within the spirit and scope of the appended claims.

What is claimed is:

1. A ceramic dispersoid in metal product, comprising:

(a) a matrix metal of aluminum and (b) a uniform cluster-free distribution of no more that two particles attached to one another at a magnification of 500× having an average particle size of less than about 0.3 microns, said finely sized metal carbide particles selected from the group consisting of Sc, Hf Nb, Mo, and V and said finely sized metal carbide particles formed and dispersed in-situ in said metal matrix of aluminum.

2. The ceramic dispersoid in metal product of claim 1 wherein said finely sized metal carbide particles are scandium carbide.

3. The ceramic dispersoid in metal product of claim 1 wherein said finely sized metal carbide particles are vanadium carbide.

4. The ceramic dispersoid in metal product of claim 1 wherein said finely sized metal carbide particles are molybdenum carbide.

* * * * *